United States Patent [19]

Yoshikawa

[11] 4,221,339

[45] Sep. 9, 1980

[54] LIQUID SPRAYING DEVICE

[75] Inventor: Satonovu Yoshikawa, Komae, Japan

[73] Assignee: Nakaya Sangyo Kabushiki Kaisha, Aichi, Japan

[21] Appl. No.: 962,036

[22] Filed: Nov. 20, 1978

[30] Foreign Application Priority Data

Dec. 3, 1977 [JP] Japan ..... 52-145493

[51] Int. Cl.[2] ..... B05B 7/10

[52] U.S. Cl. ..... 239/704; 239/400; 239/403; 239/422; 239/424

[58] Field of Search ..... 239/400, 403-406, 239/422, 424, 703, 704, 705, 706

[56] References Cited

U.S. PATENT DOCUMENTS

| | | | |
|---|---|---|---|
| 1,194,827 | 8/1916 | Edgerton | 239/422 |
| 3,059,613 | 10/1962 | Nakaya | 239/706 X |
| 3,310,240 | 3/1967 | Grundman | 239/422 X |
| 3,408,985 | 11/1968 | Sedlacsik, Jr. | 239/706 X |
| 3,499,476 | 3/1970 | Hartlapp et al. | 239/422 X |
| 3,937,011 | 2/1976 | Caruel | 239/406 X |

*Primary Examiner*—Richard A. Schacher

*Attorney, Agent, or Firm*—Wenderoth, Lind & Ponack

[57] ABSTRACT

A liquid atomizing and spraying device which can be operated with a relatively low air pressure. The spraying device has three coaxial tubular passages; an inner one for air, an intermediate one for liquid, and an outer one for air; which are shaped to have the liquid ejected as a thin film having a divergently conical shape which is caused to vibrate by the air which is being ejected in a vortex flow for generating cusps on the film in an electrostatic field for being finely atomized and projected.

6 Claims, 5 Drawing Figures

LIQUID SPRAYING DEVICE

BACKGROUND OF THE INVENTION

This invention is directed to a liquid atomizing and spraying device which is used, for example, in ordinary spray painting and electrostatic coating.

Among the liquid atomizing and spraying devices (hereinafter referred to as spraying devices) which have been known and used in electrostatic coating apparatus, the following two types are the most widely used.

(1) The first type has a means for supplying coating fluid such as varnish or paint (hereinafter referred to representatively as paint) in the form of a thin film into, for example, a cup-like rotating member which is being rotated at a constant speed and a means for impressing a high direct-current voltage between the front extremity of the cup-like rotating member and the work being coated thereby atomizing the paint with electrostatic field and causing the atomized paint particles to be deposited on the work.

(2) The second type has an orifice having an annular shape, a means for supplying paint to this orifice, a means for supplying compressed air around the outer periphery of the orifice thereby atomizing the paint with an air jet, and a means for impressing a high direct-current voltage between the work being coated and the front extremity of the orifice thereby causing the paint to be deposited on the work with excellent deposition efficiency.

However, in the electrically atomizing means of the circular rotating member of the first type, the paint spreads in the form of a thin film over the surface of the circular rotating member and, thus being exposed to air, dries and adheres thereto. For this reason, it is necessary to wash the surface of the circular rotating member over which the paint film is flowing every time the coating operation is stopped, and it becomes difficult to change colors in a short time. Furthermore, since the atomization is accomplished by electric force, sufficient atomization cannot be obtained in the case of paints having a low electrical resistance such as water-soluble paints and a coating effect due to electrostatic field cannot be practically achieved.

Furthermore, in the spraying device of the previously described second type which depends on air-jet atomization by an orifice, paint particles accumulate at the front head part of the sprayer because of the state of the air flow and give rise not only to poor coating of the work, but also to clogging of the sprayer orifice.

In general, atomization of a paint having a low electrical resistance, such as water-soluble paints, by means of an air-jet atomizing device is made possible by increasing the pressure of the compressed air or by heating the paint and lowering the surface tension thereof. However, increasing the velocity of the air stream in an electrostatic coating apparatus leads to a lowering of the deposition efficiency, the result being that it is difficult to manufacture an electrostatic coating apparatus of high efficiency.

Many research reports have been issued in recent years on processes and mechanism for atomization or fine subdivision of bodies of liquids. According to these disclosures, in the case of electrical atomization with a circular rotating member, a liquid film is formed up to the edge of the circular member and extends from the edge to generate flares, which are subjected to vibration produced by an electrically generated force and split into a mesh form. It has been found that, in the case of atomization of a liquid film due to the air flow in the above described orifice means, as the compressed air pressure is increased, the liquid film which is ejected out through the orifice, forms cusps at the forward extremity of the orifice and clearly splits into a mesh-form. It is further known that in the case of a circular rotating member which is supplied with paint at a constant flow rate, when the impressed voltage is determined, the number of ligaments generated increases with a corresponding increase in the rotational velocity of the rotating member. In the case of atomization by an air jet, it has also been experimentally found that the number of cusps generated increases as the compressed air pressure increases.

However, there is a limit to the increase of the rotational velocity of the rotating member, and the increase of the compressed air pressure is also subject to limitations due to the mechanism employed. For these reasons, the number of cusps generated is limited in all cases by the surface tension of the paint at the liquid film discharge extremity.

SUMMARY OF THE INVENTION

It is an object of this invention to provide a novel liquid spraying device which does not have the above described problems which are encountered in the prior art.

More specifically, an object of the invention is to provide a liquid spraying device by which good atomization can be attained thereby producing fine liquid particles having a small uniform size.

Another object of the invention is to provide a liquid spraying device which can be operated with a relatively low air pressure and still achieve good performance.

Still another object of the invention is to provide a liquid spraying device in which the liquid being sprayed does not accumulate on the parts of the spraying device, and thereby does not require frequent cleaning.

A further object of the invention is to provide a liquid spraying device which is capable of effectively spraying liquids having a low electrical resistance, such as water-soluble paints, without the use of high pressure compressed air or without heating of the liquid.

A further object of the invention is to provide a liquid spraying device in which the liquid being sprayed can be quickly replaced with another.

According to this invention, briefly summarized, there is provided a liquid spraying device having a construction wherein three coaxial tubular passages, namely, an inner passage for primary air, an intermediate passage for a liquid, and an outer passage for secondary air, extend coaxially to a front spraying end where the structures forming these passages are formed so that the liquid is ejected as a thin film having a divergently conical shape between the primary air and secondary air, which are ejected in vortex or whirling flows and which are directed outwardly in substantially conical shapes. The film is transformed into vibrating cusps in an electrostatic field having a high potential and is thereby finely atomized and projected.

The nature, utility, and further features of this invention will become more clearly apparent from the following detailed description when read with reference to the accompanying drawings, which are briefly described below, and throughout which like parts are designated by like reference numerals.

DETAILED DESCRIPTION

Throughout the following description, the terms "front" and "forward" designating direction or position correspond to the general direction of movement of the fluids, while the terms "rear" and "rearward" correspond to the opposite direction.

Figure 1:
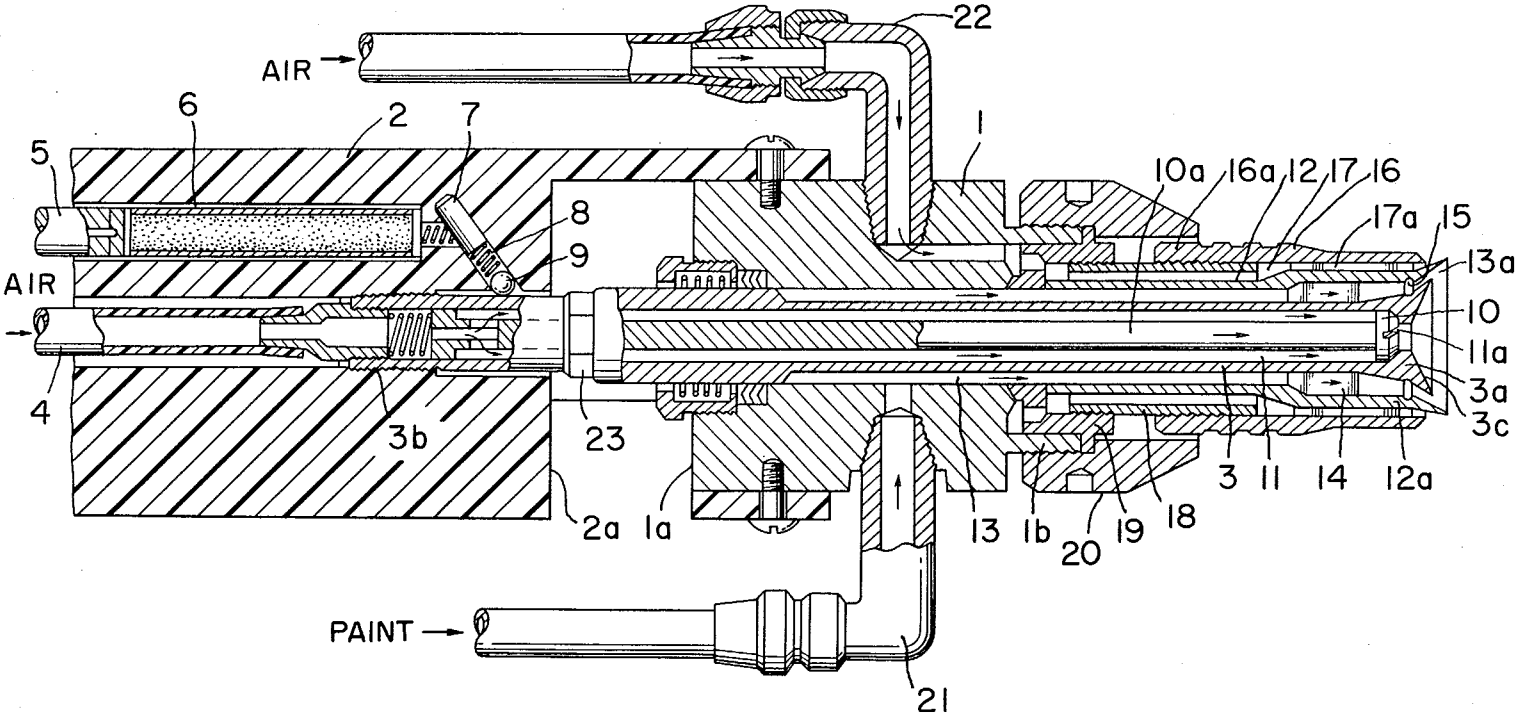
FIG. 1 is a side view, in longitudinal section, of one embodiment of the spraying device of the present invention.

Referring to FIG. 1, the coating device shown therein is an electrostatic coating machine having a main sprayer structure 1 having a rear base part 1*a*. The main sprayer structure 1 is supported at its base part 1*a* by a cylindrical structure 2 which is made of an electrically insulating material and is coaxially aligned therewith. The structure 2 has a cutout portion 2*a*. The main sprayer structure 1 centrally and coaxially supports a primary air flow guide tube 3 therein. The primary air flow guide tube 3 has at its front end, a flared, bell-shaped opening part 3*a* and is coaxially connected at its rear end to an air supply pipe 4 which is disposed along the center of the cylindrical structure 2. The guide tube 3 is screwed into the structure 2 at the near end 3*b*.

The cylindrical structure 2 has therein appropriate passages for accommodating one end of a high voltage cable 5 which is connected at its other end to a high-voltage generator (not shown), a resistor 6 which has a high resistance value for current limiting for the purpose of suppressing the generation of sparks and which is connected at one end to the cable 5, a terminal 7 to which the resistor 6 is connected, and the combination of a coil spring 8 and a ball 9 for establishing electrical contact between the terminal 7 and the outer surface of above described guide tube 3. The high-voltage cable 5 is further connected, via paint distribution vanes 14 which are described hereinafter, to a paint guide tube 12 which is disposed concentrically around the guide tube 3 with an annular space 13 therebetween. Accordingly, the front extremity of the opening part 3*a* of the primary air flow guide tube 3 forms a high voltage electrostatic field.

Figure 2:
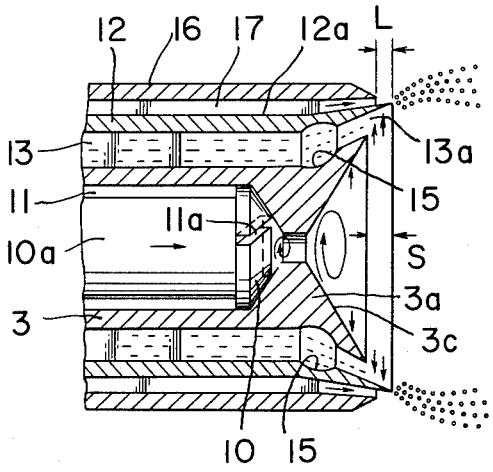
FIG. 2 is a fragmentary, enlarged side view, in longitudinal section, showing only the essential parts of the spraying device of the invention.
Figure 3:
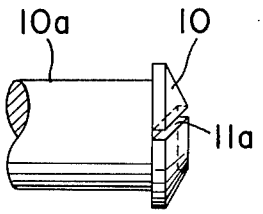
FIG. 3 is an enlarged side view of a member used for producing a whirling or vortex flow used in the spraying device of the invention.
Figure 4:
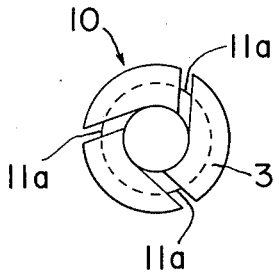
FIG. 4 is a front view of the member shown in FIG. 5.

Furthermore, a vortex flow forming head 10, as shown in FIGS. 3 and 4, is fitted within the front end part of the guide tube 3. The head 10 is located on the forward end of a support rod 10*a* which passes through the guide tube 3 and is secured at the rear end thereof to the tube 3. The support rod 10*a* forms a primary air flow passage 11 between itself and the tube 3 as shown in FIGS. 1 and 2. This vortex flow forming head 10 has at its front end a frusto-conical front face in which are locatd a plurality of tangential grooves 11*a* which extends radially inward and obliquely forward and communicate with the primary air flow passsage 11.

Thus, primary air flowing forward through the air supply pipe 4 flows further forward through the primary air flow passage 11 and the tangential grooves 11*a* and is ejected as a laminar flow along the front flared face 3*c* of the bell-shaped opening part 3*a* of the above described guide tube 3.

On the one hand, as described above, the paint guide tube 12 is disposed concentrically around the guide tube 3 with an annular space 13 which defines a paint flow passage therebetween and has at its front end a divergent frustoconical part 13*a*. In order to cause the vortex flow layer of the primary air flow to impinge effectively against the paint liquid film, it is desirable that the vertex angle of the flared face 3*c* be greater than the vertex angle of the face of the conical part 13*a*. Moreover, the front extremity of the flared face 3*c* should be disposed inwardly or rearwardly from the front extremity of the face of the conical part 13*a* by a distance S as shown in FIG. 2.

The aforementioned paint distribution vanes 14 are axially located in the paint flow passage 13 between the primary air guide tube 3 and the paint guide tube 12 near the open end 12*a* thereof. A paint accumulation part 15 is shaped like opposed slight annular depressions which are located in the outer and inner surfaces of the air guide tube 3 and the paint guide tube 12, respectively, and at the rear part of the flared bell part 3*a*.

A secondary air flow guide tube 16 is disposed concentrically around the above described paint guide tube 12, forming an air flow passage 17 therebetween. The front extremity of the tube 16 is disposed slightly rearward of the front extremity of the paint guide tube 12 by a distance L as indicated in FIG. 2. Helicoid grooves 17*a* are located between the inner wall surface of the guide tube 16 and the outer wall surface of the paint guide tube 12 and serve to create a vortex flow of the secondary air in the same whirling direction as the primary gas flow. The grooves 17*a* may be made up of parallel ribs which are integral with the tube 12. The rear end part 16*a* of this guide tube 16 is tapped and is screwed onto the front part of a nipple connector 18, the rear part of which is screwed into a flanged nut member 19. This flanged nut member 19 is firmly held against a tubular front part 1*b*, of the aforementioned main sprayer structure 1, by a nut 20 which is detachably screwed onto the tubular front part 1*b*.

A paint supply connector 21 is connected to a part of the main sprayer structure 1 and communicates with the paint flow passage 13. A secondary air flow supply connector 22 is connected to the main sprayer structure 1 at a part thereof which is opposite to the paint supply connector 21 and which communicates with the air flow passage 17.

The above described primary air flow guide tube 3 is provided at the outer part thereof with a nut part 23 which can be engaged and turned by a spanner or wrench which is inserted through the cutout 2*a* of the structure 2. By turning this nut part 23 in the loosening direction, the opening part 3*a* of the guide tube 3 can be shifted forwardly and cleaned.

The spraying device of the above described construction according to the present invention operates in the following manner.

A liquid paint is fed under pressure through the paint supply connector 21 into the paint flow passage 13, while, simultaneously, primary air and secondary air are supplied under pressure respectively through the primary air supply pipe 4 and the secondary air supply connector 22 into the air flow passages 11 and 17. The air flowing through the air flow passage 11 is thereupon forced, by the tangential grooves 11*a*, into a vortex flow whirling about the longitudinal axis and, as it revolves along the flared surface 3*c* of the guide tube 3, assumes a laminar-flow state for being ejected radially outwardly and forwardly in the shape of a cone. The air flowing through the passage 17 will be described hereinafter.

Figure 5:
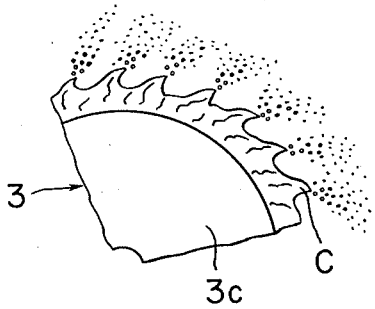
FIG. 5 is an axial view showing the action of the liquid film in the spraying device of the invention.

The pressurized paint fed into the paint flow passage 13 and flowing past the paint distribution vanes 14 is once accumulated at the paint accumulation part 15 and is then sent under pressure in a peripherally uniformly distributed state toward the frustoconical skirt 13*a* of the paint flow passage 13 to spread out uniformly in an annular form. Then, this paint, spreading out toward the opening of the skirt 13*a*, becomes a thin liquid film in the shape of a cone. The above described revolving primary air flow, also in the shape of a cone, collides against the surface of said film from inward to induce vibration of the film. It will be understood that this collision of the primary air flow against the surface of the thin liquid film is possible because of the greater vertex angle of the flared face 3*c* than that of the face of the conical part 13*a* and because of the disposition from the front extremity of the flared face 3*c* rearwardly of the front extremity of the conical part 13*a*. The thin liquid film flow which is thus subjected to the impact of the revolving primary air flow becomes cusps C, as indicated in FIG. 5, directly in front of the transition region of a finely atomizing process.

It has been found that, in this case, a primary air flow of a character such as to induce waves in the paint film spreading out is sufficient, and it is not necessary to increase the air pressure to a value to cause the transformation into fine particles. It has been further found that the smaller the number of the tangential grooves 11*a* in the front face of the vortex flow forming head 10, the greater the fluctuation or non-uniformity in the vortex flow, which is effective for inducing waves in the spreading paint.

As briefly described above, the secondary air is fed by an air compressor (not shown) through the secondary air flow supply connector 22 and into the air flow passage 17 and is twisted by the helicoid grooves 17*a* into a vortex flow with having the same rotational direction as the primary air. This whirling air imparts a suction action on the above described cusps C, which are vibrating because of the high voltage field in the region at the front end of the paint guide tube 12. This region is one of electric discharge of high voltage which is supplied through the high-voltage cable 5, whereby the cusps C are divided into fine particles. At the same time, the electrostatically charged particles of the paint are sprayed in a direction determined by the combination of the primary and secondary air flows as these charged particles are whirled into rotation. The charged particles are thus sprayed against and deposited on the article being coated, which is grounded.

Examples of specific conditions and details relating to an example of the spraying device of the invention illustrated in FIG. 1 are set forth below, it being understood that these details are presented as illustrative only and are not intended to limit the scope of the invention.

The coating liquid (paint) used in the spraying device was a polyvinyl acetate emulsion paint diluted with distilled water and having a viscosity of 40 seconds with Ford Cup. No. 4. Tests were conducted with a secondary air flow pressure of 1.5 kg./cm.$^2$ gauge, and an impressed voltage of 80 KV at a paint delivery rate of 25 cc./min.. The largest diameter of the flared face 3*c* of the air guide tube 3 was 24 mm, the vertex angle of the face 3*c* 160°, the largest diameter of the frustconical face 13*a* 25 mm, the vertex angle of the face 13*a* 150°, and the distance S 0.5 millimeter. A first test was conducted with the primary and secondary air flows being ejected and a second test was conducted with only the secondary air flow being ejected as in the known devices. The results of these two tests were compared. As a result, it was found that, in the case where the primary and secondary air flows were both ejected, no accumulation of paint particles at the front end of the sprayer was observable, and the generation of a large number of cusps was observed. The average particle size was small with a uniform distribution of the particles, and good atomization being attained.

Furthermore, for the cases where the gap between the front extremities of the secondary air flow guide tube 16 and of the paint guide tube 12 was 0.3 mm. and 1.0 mm., respectively, the average particle sizes were compared when the primary and secondary air flows were both ejected. As a result, almost no difference was observed, whereby it became clear that the paint outlet orifice can have a large diameter. This means that the problem of clogging of the paint orifice is solved.

Similar results were obtained when a paint having a high nonvolatile content comprising an aminopolyester paint with a solid content of 75 weight percent was used. Since the specific electrical resistance of the paint can be made high, for example, 50 MΩ-cm., better atomized paint particles than in the case of water-soluble paints can be obtained with low air pressure of the secondary air flow because of the multiple effect of the liquid film vibration due to high voltage and the liquid film vibration due to the primary air flow.

Thus, in the operation of the spraying device of the above described arrangement according to this invention, the paint fed through the paint flow passage 13 and arriving at the outlet skirt 13*a* is formed into a liquid film having a wavy state by the air flows in the primary air flow passage 11 and the secondary air flow passage 17, this liquid paint film becomes cusps in the electrostatic field due to high voltage, and waves are induced in this paint film thus spreading out, whereby it is atomized into uniform paint particles even with a low pressure air current. Moreover, contamination of the front extremity of the sprayer is eliminated, whereby frequent cleaning become unnecessary. In addition, changing of paints can be readily carried out. Still another advantageous feature of the spraying device of this invention is that, since the atomization can be carried out as air jets are supplied to the paint orifice in a constantly clean state, a stable and uninterrupted spray coating is possible.

I claim:

1. A liquid spraying device, comprising:

a first tube made of electrically conducting material and having at a front end thereof a flared, bell-shaped opening having a concavely conical front surface which diverges forward in the direction of liquid spray, at a specific vertex angle;

vortex flow means located within said first tube and defining, with said wall of said first tube, a primary air flow passage, said vortex flow means having a forward head portion having a shape for ejecting primary air flowing through said air passages and causing said air to flow vortically in the shape of a cone along said concavely conical front surface;

a second tube, made of electrically conducting material, being coaxially disposed around said first tube and defining together therewith a liquid passage through which liquid flows, said second tube having at a front end thereof a flared, bell-shaped opening having a concavely frusto-conical front surface around said first tube concavely conical front surface, whereby liquid flowing through said liquid passage forms a cone-shaped thin film on said frusto-conical front surface, said frusto-conical front surface diverging forward at a vertex angle smaller than said vertex angle of said first tube front surface, the forward edge of said first tube conical front surface being disposed axially to the rear of the forward edge of said second tube frusto-conical front surface whereby said vortically flowing air collides against said thin film of liquid for causing said film to vibrate;

a third tube coaxially disposed around said second tube for defining together therewith a secondary air flow passage, said third tube having a front end disposed around said front end of said second tube and having vortical flow means for causing secondary air to flow vortically in the same direction as said vortically flowing primary air from said primary air flow passage;

air supply means for supplying primary and secondary air flows under pressure through said primary and secondary air flow passages respectively to said front ends thereof;

liquid supply means for supplying said liquid under a pressure through said liquid passage to said front end thereof; and voltage means for applying a high voltage of one polarity to said first and second tubes for creating respective electrostatic fields for cooperating with said vortical flows of primary and secondary air for promoting atomization and spraying of the liquid.

2. A liquid spraying device as claimed in claim 1, wherein said forward head portion of said vortex flow means has a plurality of tangential grooves located thereon, said grooves being directed obliquely forward and radially inward relative to the longitudinal axis of said vortex flow means forward head portion.

3. A liquid spraying device as claimed in claim 1 or 2 wherein the front edge of said third tube is located axially to the rear of the front edge of said frusto-conical front edge of said second tube.

4. A liquid spraying device as claimed in claims 1 or 2 wherein said vortical flow means of said third tube has helicoid grooves located along the inner wall surface near the front end of said third tube.

5. A liquid spraying device as claimed in claims 1 or 2 wherein said liquid passage further comprises liquid accumulation means near the front end thereof for causing liquid to accumulate therein.

6. A liquid spraying device as claimed in claim 5 wherein said liquid accumulation means comprises an enlarged cross sectional area portion of said second passage.

* * * * *